United States Patent [19]

Miller

[11] Patent Number: 4,821,482

[45] Date of Patent: Apr. 18, 1989

[54] CLIP FASTENER

[76] Inventor: Fred W. Miller, 47 Nottingham La., Inglis, Fla. 32649

[21] Appl. No.: 65,046

[22] Filed: Jun. 9, 1987

[51] Int. Cl.[4] ..... E04B 1/40

[52] U.S. Cl. ..... 52/714; 52/712; 52/715

[58] Field of Search ..... 52/712–715, 52/520, 735

[56] References Cited

U.S. PATENT DOCUMENTS

| | | | |
|---|---|---|---|
| 656,364 | 8/1900 | McDowell | 52/715 X |
| 1,146,251 | 7/1915 | Harp | 52/715 |
| 2,386,887 | 10/1945 | Eckel | 52/715 X |
| 3,889,437 | 6/1975 | Day et al. | 52/520 |
| 3,998,019 | 12/1976 | Reinwall | 52/520 X |
| 4,000,596 | 1/1977 | Magill et al. | 52/714 X |
| 4,114,340 | 9/1978 | Dean et al. | 52/520 |
| 4,417,431 | 11/1983 | Commins et al. | 52/520 X |
| 4,575,983 | 3/1986 | Lott et al. | 52/520 X |

FOREIGN PATENT DOCUMENTS

| | | | |
|---|---|---|---|
| 1200845 | 7/1959 | France | 52/735 |

*Primary Examiner*—J. Karl Bell

*Attorney, Agent, or Firm*—Richard C. Litman

[57] ABSTRACT

A removable L-shaped clip fastener of integral, one-piece construction, that is inserted between the risers of installed metal structural roof panels for use in attaching and supporting insulated ceilings, light fixtures, paddle fans, simulated beams. The clip fastener has a long leg and a short leg normal thereto. The long leg has and arcuate and edge-sharpened distal portion to facilitate insertion of the long leg between the risers; the long leg has bent-back ears defining limit stops to limit the extent of insertion of the long leg between the risers; the long leg has a longitudinal axis; and the long leg has a twisted portion at an angle of approximately 22.5 degrees in a radial direction relative to the longitudinal axis of the long leg, and such twisted portion wedges against the inside surfaces of the risers to render the clip fastener self-tightened and self-locked.

13 Claims, 2 Drawing Sheets

CLIP FASTENER

BACKGROUND OF THE INVENTION

1. Technical Field

This invention relates to a clip fastener that is inserted into the crevice between the risers of installed metal structural roof panels. The clip fastener is self-tightening and self-locking upon appropriate insertion. The clip fastener can be used to support insulated ceilings, light fixtures, paddle fans, simulated beams, etc. to a roof panel system which has been previously installed by use of various known means and wherein adjacent panels present vertically extending normally flushly juxtaposed risers.

2. Background

In the prior art, screw holes or bolt holes are made in structural roof panels so that screws or bolts, as the case may be, can be employed to attach insulated ceilings, light fixtures, paddle fans, simulated beams to such structural roof panels. When steel sheet metal screws are employed as fasteners, especially in aluminum structural roof panels, bimetallic corrosion results because of electron flow, thereby weakening and eventually rendering such fasteners useless. Moreover, site preparation in such roof panels by drilling starter holes for the screws or holes for the bolts is time-consuming with consequent expense for labor costs involved. The problem in the art, therefore, is the need for a clip fastener to attach insulated ceilings, light fixtures, paddle fans, simulated beams to structural roof panels that can be inserted into the crevices between the risers of the installed metal structural roof panels simply, safely and with little effort, and without damage to such roof panels nor consequent bimetallic corrosion.

SUMMARY OF THE INVENTION

Accordingly, the object of the invention is to contribute to the solution of the discussed problem of the art by providing a self-tightening and self-locking clip fastener that can be inserted, per se, between the risers of installed metal structural roof panels and utilized to attach insulated ceilings, light fixtures, paddle fans, simulated beams.

BRIEF DESCRIPTION OF THE DRAWINGS

This object and other objects of the invention should be discerned and appreciated by the detailed specification taken in conjunction with the drawings, wherein like reference numerals refer to similar parts, in which.

DESCRIPTION OF THE PREFERRED EMBODIMENT

Figure 1:
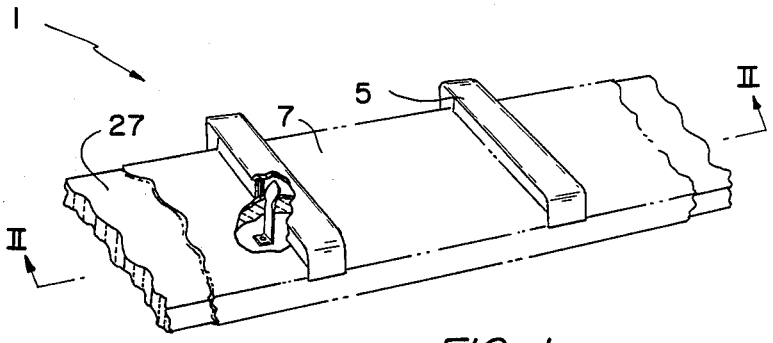
FIG. 1 shows styrofoam insulating ceiling panels flush against the underside of and attached to a structural roof panel having risers by means of the clip fasteners of the invention inserted between such risers.

In FIG. 1 of the drawings, reference numeral 1 generally refers to the invention of the aluminum clip fastener of integral, one-piece construction, formed of strip blade-like material shown inserted into the crevice 3 between the cleat-crimped-over risers 5 of an installed aluminum structural roof panel 7. Normally, the opposed inside surface 6—6 of each pair of crimped together risers 5—5 are flushly engaged. Preparatory to the insertion of clip fastener 1, a knife-like tool (not shown) is used to open up the crevice 3 slightly so that the distal tip 9 of the clip fastener 1 can start in.

Clip fastener 1 is L-shaped, and, as such, has a long leg 11 and a short leg 13 normal to long leg 11. The distal tip 9 of long leg 11 is of arcuate configuration and is sharpened along its leading or uppermost surface 10. Long leg 11 has bent-back ears 15 having upwardly directed shoulders 16 which function as limit stops. The upper portion 17 of long leg 11 is twisted at an angle of approximately 22.5 degrees in a radial direction relative to the longitudinal axis of long leg 11. Short leg 13 includes a planar upper surface 14, has a tapped hole 19 and a depending registry tab 21, formed from short leg 13.

To insert the long leg 11 within the crevice 3 after the distal tip 9 has been started in, appropriate force is applied in a longitudinal direction relative to long leg 11 at the proximal junction 23 of long leg 11 and short leg 13 by pushing or lightly tapping until the bent-back shoulders 16 of the ears 15 abut the bottoms 25 of risers 5 and hence act as limit stops to prevent further insertion, and at which point the short leg 13 will then be angularly square with roof panel 7. Such 22.5 degrees twist in the upper portion 17 of long leg 11 has a camming effect against the inside surfaces of risers 5 which results in the clip fastener 1 remaining self-tightened and self-locked so long as the short leg 13 is maintained square with the roof panel 7 and not allowed to untwist. All of the accessories are designed to be attached to and supported by two or more clip fasteners 1 so that the clip fasteners 1 are maintained square with the roof panel 7 and not allowed to untwist. Of course, clip fastener 1 can be removed by pulling down on it and allowing it to reverse the twist with which it was installed.

Figure 2:
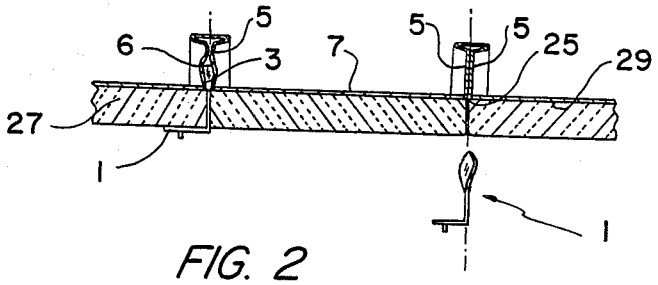
FIG. 2 is a sectional view taken along the line in the direction of the arrows 2—2 in FIG. 1.
Figure 3:
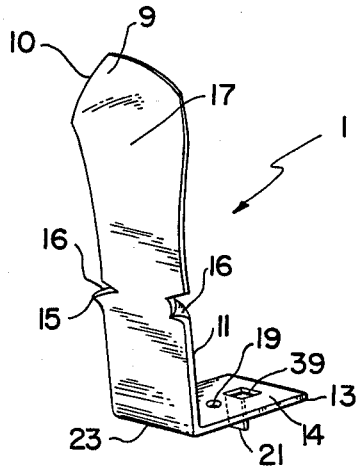
FIG. 3 is a perspective view of the clip fastener.
Figure 4:
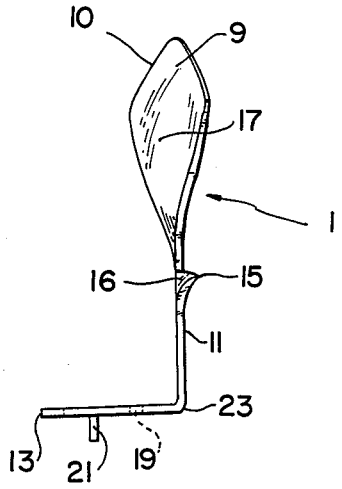
FIG. 4 is a side view of the clip fastener.
Figure 5:
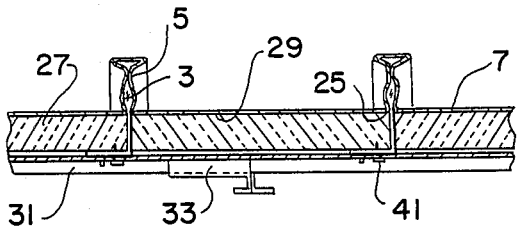
FIG. 5 is a sectional view showing insulated styrafoam ceiling panels attached to a structural roof panel by means of the clip fastener inserted between roof panel risers and showing a longitudinal track accessory fixed to the clip fasteners.

FIGS. 2 and 5 show flat styrafoam insulating ceiling panels 27 installed in abutting relationship flush against the flat bottom surface 29 of the aluminum structural roof panel 7 and held in place by the abutting relationship of the planar upper surface 14 of the short leg 13 with insulating ceiling panel 27. It should be noted that the vertical distance between the proximal junction 23 and bent-back ears 15 will be the same as the thickness of the insulating ceiling panel 27 so that such insulating ceiling panel 27 will be maintained flush against the flat bottom surface 29 of the structural roof panel 7 thereby providing insulation and preventing any condensation from arising.

Figure 6:
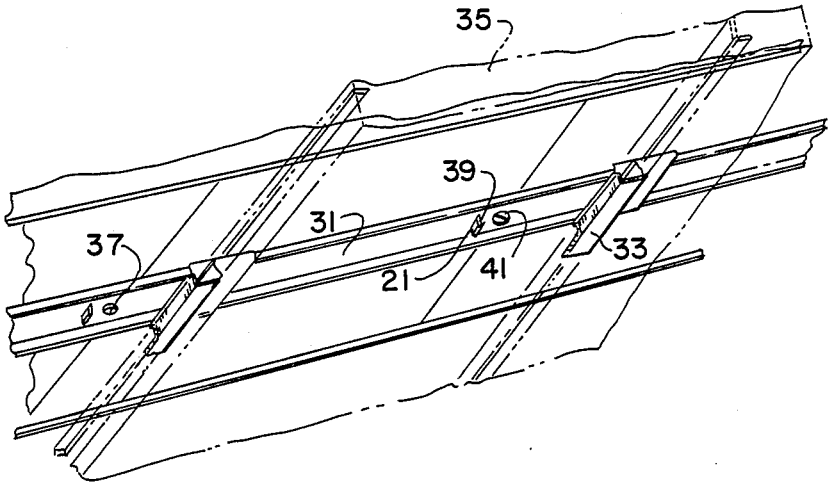
FIG. 6 is a perspective view showing the longitudinal track accessory mounting and supporting decorative acoustical ceiling panels.

FIGS. 5 and 6 show an accessory 31 that is attached and supported by the clip fasteners 1 so that the clip fasteners 1 are maintained square with roof panel 7 and not allowed to untwist. Accessory 31 is a longitudinal track with slides which mount and support acoustical ceiling panels 35 shown in phantom lines. Longitudinal track accessory 31 has guide holes 37 and 39 which are aligned with and correspond with respective tapped holes 19 and depending tabs 21 of the short legs 13.

Longitudinal track accessory 31 is appropriately positioned and disposed such that the depending tabs 21 extending from their corresponding holes 39 and the guide holes 37 are aligned with corresponding tapped holes 19 in the short leg 13. Then the shank portions of aluminum sheet metal screws 41 are inserted through complemental guide holes 37 and appropriately engaged in tightened relationship with tapped holes 19. With the longitudinal track accessory 31 installed as thusly described, the short legs 13 are maintained square with the roof panel 7 and the clip fasteners 1 are not allowed to untwist. The tabs 21 and tapped holes 19 will be seen to provide registry and fastening means allowing of positive and secure attachment of the track accessory 31. Installed as described, the upper surface of longitudinal track accessory 31 will abut against and support such insulating ceiling panels 27. The fact that the clip fasteners 1 and roof panels 7 are aluminum will prevent bimetallic corrosion. Thereafter tongue-in-groove decorative acoustical ceiling panels 35 are installed flat and flush against the insulating panels 27. Such decorative panels 35 are maintained as installed by means of slides 33 retentively engaged with and holding complemental longitudinal slots (not shown) formed in the decorative acoustical ceiling panels 35.

Having thusly described my invention, I claim:

1. A removable, self-tightening and self-locking clip fastener of integral construction for attachment to installed roofing including metal structural roof panels having pairs of vertically extending juxtaposed risers between adjacent ones of a plurality of roof panels, for use in attaching and supporting insulated ceilings, light fixtures, paddle fans, simulated beams and the like, comprising:

a substantially horizontally disposed short leg joined to a substantially vertically disposed long leg terminating in an uppermost distal tip, said distal tip disposed in the plane of the longitudinal axis of said long leg, camming means on said long leg including a radially twisted portion of said long leg adjacent said distal tip, stop means on said long leg intermediate said twisted portion and said short leg, and the vertical extent between said stop means and said distal tip being no greater than the vertical extent of said risers, whereby said clip long leg is insertable between a pair of said juxtaposed risers with said stop means engageable with said panels to limit the insertion of said long leg as said twisted portion laterally deflects a portion of said juxtaposed risers to form a pocket therebetween and retain said clip in its inserted position.

2. A clip fastener in accordance with claim 1, wherein said distal portion is of arcuate configuration.

3. A clip fastener in accordance with claim 1, wherein said distal portion has sharpened edges.

4. A clip fastener in accordance with claim 1, wherein said distal portion is of arcuate configuration and has sharpened edges.

5. A clip fastener according to claim 1 wherein, said stop means includes bent-back ears struck from the material of said long leg and providing upwardly facing shoulders.

6. A clip fastener according to claim 1 including, registry means on said short leg whereby, disparate members may be positively aligned with said clip following said insertion thereof between said risers.

7. A clip fastener according to claim 1 including, fastener means on said short leg whereby, disparate members may be securely attached to said clip following said insertion thereof between said risers.

8. A clip fastener according to claim 1 including, registry and fastener means on said short leg whereby, disparate members may be aligned with and attached to said clip following said insertion thereof between said risers.

9. A clip fastener according to claim 1 wherein, said long and short legs are formed of blade-like strip material.

10. A clip fastener according to claim 1 wherein, said radially twisted portion is twisted substantially 22.5 degrees relative the normal plane of said long leg.

11. A clip fastener according to claim 1 wherein, said distal tip comprises a point.

12. A clip fastener according to claim 6 wherein, said registry means includes a tab depending from said short leg.

13. A clip fastener according to claim 7 wherein, said fastening means includes a tapped hole in said short leg.

* * * * *